US005212913A

United States Patent [19]

Whitehead

[11] Patent Number: 5,212,913

[45] Date of Patent: May 25, 1993

[54] ANGLED RIDGE FITTING FOR FORMING ROOF OF MODULAR BUILDING

[75] Inventor: Steven P. Whitehead, Elgin, Ill.

[73] Assignee: Suncast Corporation, Batavia, Ill.

[21] Appl. No.: 831,206

[22] Filed: Feb. 3, 1992

[51] Int. Cl.[5] ..... E04D 1/30

[52] U.S. Cl. ..... 52/57; 52/199

[58] Field of Search ..... 52/57, 199, 200

[56] References Cited

U.S. PATENT DOCUMENTS

| | | | |
|---|---|---|---|
| 1,765,121 | 6/1930 | Audet . | |
| 2,071,666 | 2/1937 | Sylvan | 52/199 |
| 3,802,134 | 4/1974 | McCorvey . | |
| 4,015,374 | 4/1977 | Epstein et al. . | |
| 4,080,083 | 3/1978 | Malott | 52/199 |
| 4,322,924 | 4/1982 | Cooper | 52/57 |
| 4,532,739 | 8/1985 | Cooper | 52/57 |
| 4,577,442 | 3/1986 | Callaway | 52/57 |
| 4,685,265 | 8/1987 | Cooper | 52/57 |
| 4,803,813 | 2/1989 | Fiterman | 52/57 |
| 5,094,041 | 3/1992 | Kasner et al. | 52/199 |

FOREIGN PATENT DOCUMENTS 2846025 4/1980 Fed. Rep. of Germany ..... 52/199

*Primary Examiner*—David A. Scherbel
*Assistant Examiner*—Joanne C. Downs
*Attorney, Agent, or Firm*—Fitch, Even, Tabin & Flannery

[57] ABSTRACT

Disclosed is a ridge fitting for rapidly and securely connecting adjacent roof panels of a modular building together at an angle to one another. The ridge fitting comprises a thin wall having panel receiving channels on opposite sides thereof. The section of thin wall between opposite channels is formed of a suitable light transmitting polymer such that the thin wall serves as a sunroof, allowing sunlight to pass therethrough to provide illumination of the interior of the building. The material selected for the thin wall of the ridge fitting also provides flexibility to allow the angle between the adjacent roof panels to be varied to suit the specific requirements of a particular application.

9 Claims, 3 Drawing Sheets

ANGLED RIDGE FITTING FOR FORMING ROOF OF MODULAR BUILDING

FIELD OF THE INVENTION

The present invention relates to modular structures, and more particularly relates to modular buildings having ridge fittings for forming a roof with light transmitting characteristics to allow illumination of the building interior.

BACKGROUND OF THE INVENTION

Modular buildings, wherein a plurality of preformed components are joined together to form a composite structure, are in widespread use and have gained acceptance due to the cost savings and simplicity associated with assembly of such units.

In one type of modular construction, it is known to provide a plurality of panels which can be interconnected by engagement of dovetail joints provided at the sides of the panels. This arrangement has been found to allow simple and rapid assembly. It is desired to provide means for employing such easily interconnecting panels to form an angled roof. More specifically, it is desired to provide means for connecting adjacent roof panels in a simple and rapid manner at an angle to one another. Furthermore, it is desired that the angled roof forming means allow for the formation of a variety of various roof configurations.

Oftentimes such buildings are assembled at a remote location at which there is no access to electrical power. It is desired that the angled roof forming means provide illumination of the interior of the modular building despite the lack of an electrical power supply.

SUMMARY OF THE INVENTION

In accordance with the present invention, an elongated ridge member is provided which allows adjacent roof panels to be interconnected at an angle to one another in a simple and rapid manner. The ridge member comprises a thin wall having panel-receiving channels on opposite sides thereof for securing adjacent panels, with the thin wall section between the panel-receiving channels allowing for flexibility thereat to allow the adjacent panels to conform to any selected angle with respect to one another between approximately 135° and 170°. The channel arrangement facilitates simple and rapid assembly, while providing secure engagement.

Additionally, the ridge member is formed of a suitable polymeric material which allows sunlight to pass through the thin wall portion thereof, thus providing illumination of the interior of the building. The ridge member of the present invention thus serves structurally as a roof panel interconnecting component, and aesthetically as an interior illuminating component.

BRIEF DESCRIPTION OF THE DRAWINGS

In the drawings, wherein like elements are referenced alike.

DETAILED DESCRIPTION OF THE PREFERRED EMBODIMENTS

Figure 1:
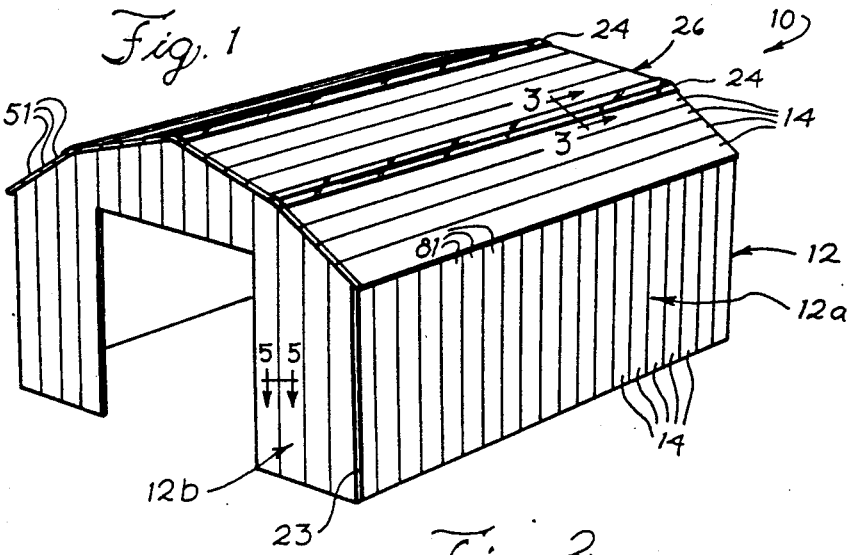
FIG. 1 is a perspective view of a modular building embodying various features of the present invention.
Figure 5:
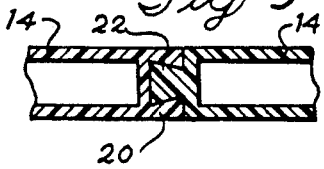
FIG. 5 is a cross-sectional view of interlocked panels, taken along line 5—5 of FIG. 1.
Figure 8:
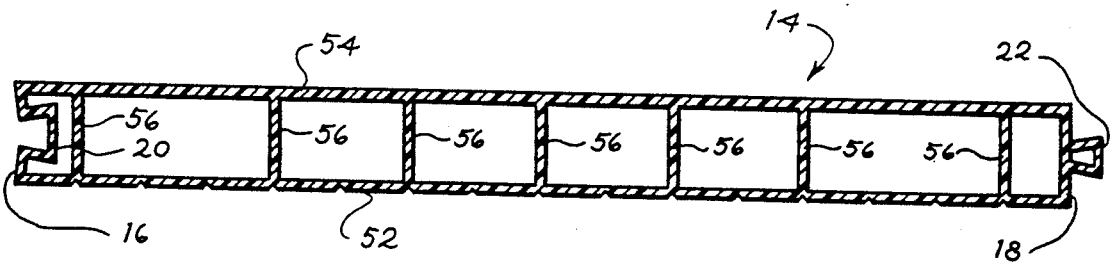
FIG. 8 is a cross-sectional view of a panel.

A modular building embodying various features of the present invention is illustrated in FIG. 1 and referred to generally at 10. The walls, indicated generally at. 12, are comprised of a plurality of interconnected panels 14. As seen in FIG. 8, each of the panels 14 includes opposite sides 16 and 18, which respectively include a fan-shaped tenon 20 on one side and a corresponding complementary mortise 22 on the other side. Accordingly, the panels 14 can be connected to one another along their sides 16 and 18 by sliding the fan-shaped tenon 20 of one panel 14 into the complementary mortise 22 of an adjacent panel to form a tight interlocking joint therebetween, as shown in the cross-sectional view of FIG. 5. This type of interlock is well known in the art, and the connection is referred to as a "dovetail joint."

By connecting a series of panels 14 together, a generally planar elongated wall 12 or roof section 26 is formed. The length of wall 12 or roof section 26 formed is thus limited only by the number of panels 14 connected. By way of example, the building of FIG. 1 shows a side wall 12*a* having twenty interconnected panels 14. Screws, not shown, are preferably screwed into the dovetail joint of interconnected panels 14, extending through both the tenon 20 and mortise 22, to solidly secure adjacent panels 14 together.

Figure 9:
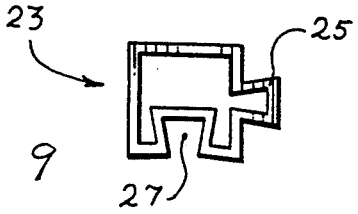
FIG. 9 is an end view of a corner fitting.

Corner fittings 23, such as that illustrated in FIG. 9, connect adjacent walls 12 of the building 10 perpendicularly to one another. As seen in the end view of FIG. 9, the corner fitting 23 is a generally square, elongated member having a fan-shaped tenon 25 and mortise 27 at adjacent, perpendicular sides thereof for receipt of the complementary tenon 20 and mortise 22 of the wall panels 14 therein. Hence, front and rear walls 12*b* and lateral sidewalls 12*a* are easily and rapidly assembled to form the walls of the building.

Since it is desired for each of the walls 12 to extend generally planar, there is no need for employment of the ridge fitting 24 of the present invention in the walls. However, the roof 26 is not planar, and the angled ridge fittings 24 of the present invention are employed to form angled sections of the roof 26.

Figure 2:
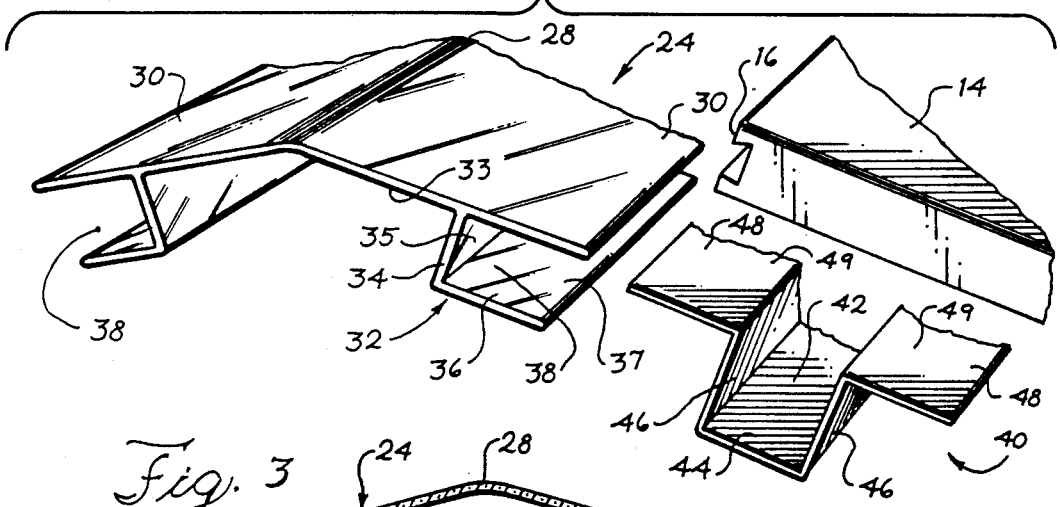
FIG. 2 is a perspective view of a ridge fitting and connecting bracket embodying various features of the present invention.
Figure 3:
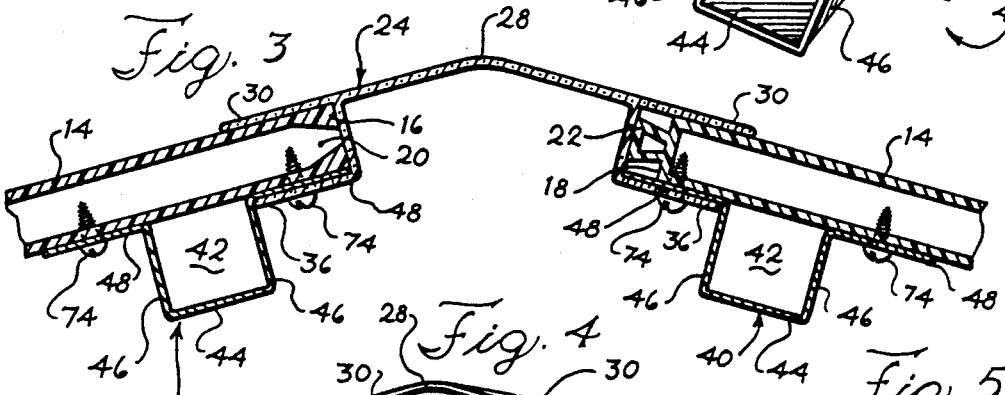
FIG. 3 is a cross-sectional view of a ridge fitting connecting two adjacent roof panels, taken along line 3—3 of FIG. 1.

A ridge fitting 24 embodying various features of the present invention is illustrated in FIG. 2 and shown in cross section in FIG. 3. The ridge fitting 24 of the preferred embodiment is symmetrical, having a central ridge 28 extending longitudinally lengthwise thereof with angled sides 30 extending from opposite sides of said central ridge 28. That is, the angled sides 30 intersect one another along the ridge 28 and extend at an angle with respect to one another.

The ridge fitting 24 further includes means at the angled sides 30 thereof for engageably receiving the sides 16 and 18 of adjacent roof panels 14 to interconnect a pair of adjacent roof panels 14. With reference now to FIG. 3, in the preferred embodiment of the invention, the engaging means includes L-shaped brackets 32 depending from the underside 33 of the angled sides 30. The brackets 32 comprise a vertical leg 34 which depends generally perpendicularly from the underside 33 of the angled side 30, and a horizontal leg 36 formed integral with the vertical leg 34 and extending generally perpendicular to the vertical leg 34, such that the horizontal leg 36 extends parallel to, and spaced a predetermined distance from, the underside 33 of the angled sides 30.

Hence, as seen in FIGS. 2 and 3, at the opposite sides of the ridge member 24, there are channels 38 both of which are defined by the underside 33 of the angled side 30, the outer side 35 of the vertical leg 34, and the upper side 37 of the horizontal leg 36. A lateral side 16 or 18 of a first panel 14 is slidably received in one channel 38, and a lateral side 16 or 18 of an adjacent panel 14 is slidably received in the other channel 38, to interconnect the adjacent panels at an angle with respect to one another, as illustrated in cross-section in FIG. 3.

Figure 4:
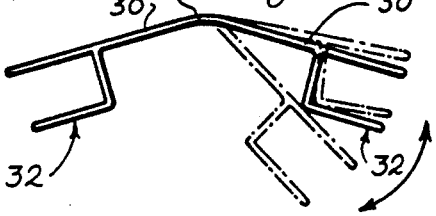
FIG. 4 is a side elevational view of the ridge fitting of FIG. 2, with the range of angular flexibility thereof indicated by skeletal lines.

To assure that the panels 14 are maintained firmly within the channels 38 of the ridge member 24, elongated brackets 40 are employed as illustrated in FIG. 3 to secure the connection of the panels 14 to the ridge member 24. The bracket 40 is substantially symmetrical and has a central channel 42 of generally U-shaped cross section as seen in FIGS. 3 and 4. The channel 42 is defined by a bottom wall 44, and sidewalls 46. Thin slats 48 extend perpendicularly outward from the upper end of the bracket sidewalls 46.

With continued reference to FIGS. 2 and 3, in assembling the roof 26, one of the thin slats 48 of the bracket 40 is placed into the channel 38 of the ridge member 24, flush against the upper surface 37 of the horizontal leg 36 of the ridge member 24. A lateral end of a panel 14 is then also inserted into the channel 38 of the ridge member 24, flush with the upper surfaces 49 of the slats 48. The construction of the ridge member 24 is such that either lateral side 16 or 18 of the panels 14 may be engageably received in the channel 38 thereof. As seen in FIG. 3, self-threading screws 74 are screwed through both bracket slats 48 into the roof panel 14 to prevent the panels 14 from being separated from the ridge member 24 during construction of the building 10 as well as throughout the useful life thereof.

More specifically, screws 74 are driven through the horizontal leg 36 of the ridge member 24, through apertures provided in the bracket slat 48, and then driven into the panel 14 at a number of locations along the length of the roof panel 14. Similarly, screws 74 are screwed through the apertures of the other bracket slat 48 and driven into the roof panel 14 at a number of locations along the length of the panel 14. Since the ridge member 24, panel 14 and bracket 40 are all elongated members which span opposite front and rear walls 12*b* of the building 10, a number of screws 74 must be employed along the length of the ridge members 24 to secure the lateral ends of the panels 14 within the channel 38 of the ridge member 24 along its entire elongated length. The outer seams at the interface of adjacent panels 14 and ridge members 24 are caulked to prevent leakage therethrough.

The ridge member 24 is formed of a suitable polymeric material which possesses the dual attributes of both allowing significant flexibility of a thin sheet of the polymer, such as the thin wall of the ridge member, and allowing at least some sunlight to pass through the polymer without significantly deteriorating the material. More specifically, to allow the requisite angular flexibility of the ridge member 24, the ridge member 24 should be formed of a polymer having a flexural modulus of between approximately 1,500 MPa and 3,000 MPa, and more preferably between approximately 2,000 MPa and 2,500 MPa, and still more preferably approximately 2,300 MPa. Lexan 101 resin has been found to be particularly well suited for carrying out the invention due to its possession of these characteristics. Translucent vinyl stabilized against decomposition has also been found to be well suited for carrying out the invention.

With reference to FIG. 1, the overall construction of a building 10 utilizing the ridge member 24 of the present invention will be explained in detail. The panels 14, brackets 40 and ridge members 24 may be formed or pre-cut to predetermined lengths and shapes, and sold together as a package which can be readily assembled to form a building of predetermined size and shape. Alternatively, long, generally uniform lengths of panels 14, brackets 40 and ridge members 24 may be sold, with the purchaser cutting the panels 14, brackets 40 and ridge members 24 to a desired length and shape, thereby allowing the purchaser to customize a building to a desired shape and size.

The ridge member 24 of the present invention facilitates such customization in that it flexes to accommodate roof ridge angles of anywhere between approximately 135° and 170°, as best illustrated in FIG. 4. That is, the ridge member 24 connects adjacent roof panels 14 together at an angle to one another, between approximately 135° and 170°. The provision of a thin interface at the ridge 28 connecting the opposite panel engaging means, which are brackets 32 in the preferred embodiment of the invention, provides the desired angular flexibility thereat. Hence, with the ridge fitting 24 of the present invention, there is no need to manufacture separate ridge fittings for each particular application in which a different roof ridge angle is desired. A single ridge member 24 constructed in accordance with the present invention accommodates any desired roof ridge angle between approximately 135° and 170°.

Figure 10:
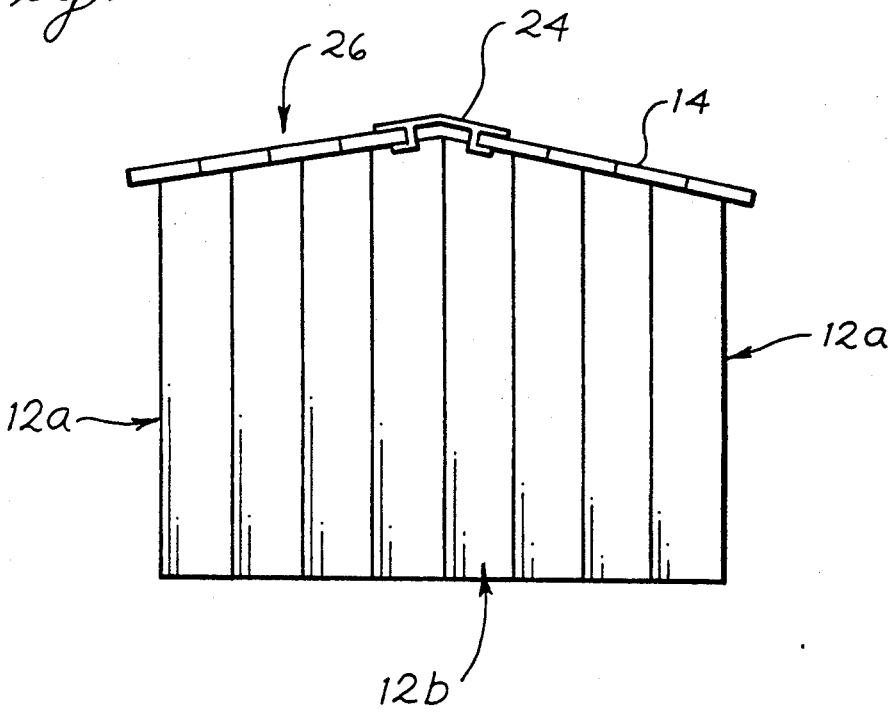
FIG. 10 is a plan view of an alternative embodiment of a building employing the ridge fitting of the present invention.
Figure 11:
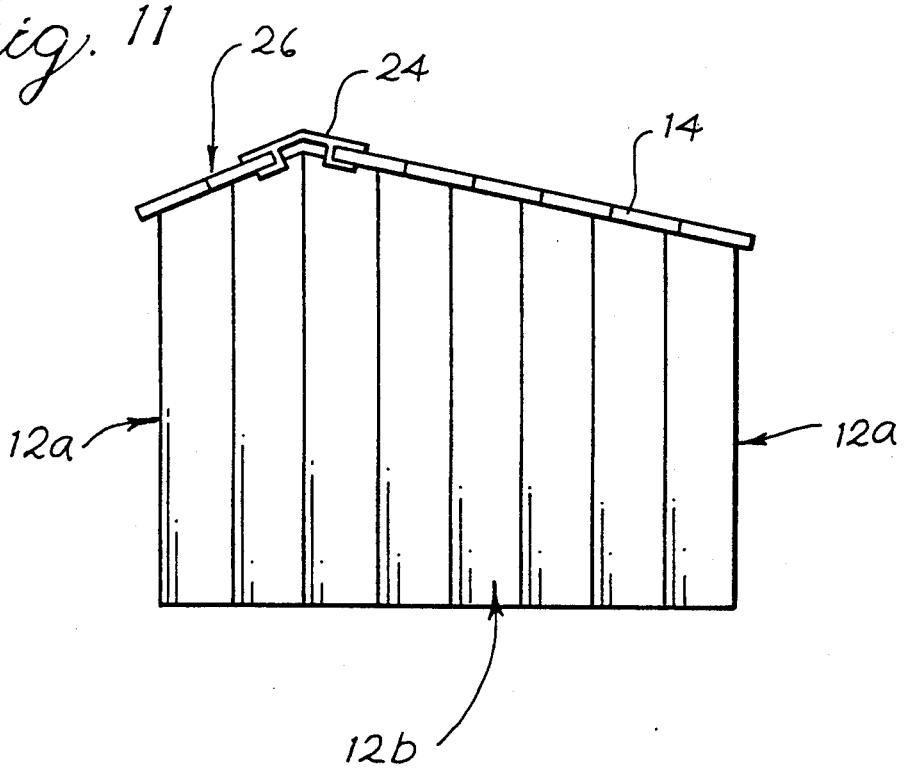
FIG. 11 is a plan view of another alternative embodiment of a building employing the ridge fitting of the present invention.

The ridge fitting 24 of the present invention lends itself to inexpensive manufacture in that it can be produced by extrusion. Furthermore, a significant proportion of the cost of producing such items lies in the initial die purchase and set-up time. Since only a single shape of ridge fitting need be produced which accommodates a wide range of roof ridge angles, there is no need to purchase and set up separate dies corresponding to each different roof ridge angle desired. Only a single run on a single mold die is required to provide a ridge fitting suitable for a wide range of roof angles. Therefore, only two different plastic parts need to be produced to form modular sheds such as those shown in FIGS. 1, 10 and 11; that is, panels 14 and ridge members 24. The user or the factory can cut the panels 14 forming the walls to the desired height and the upper ends of the panels 14 to the desired angle, and position and bend the ridge fittings to accommodate the wall design and angle selected, to form a customized modular building.

Other angular ranges may be realized and utilized by selection of an appropriate material, however structural integrity is diminished with more flexible polymers and there is generally little need for the angle of roof ridges to lie outside this range. Ridge members 24 having such additional flexibility are, nonetheless, within the scope of the invention.

With the ridge member 24 of the present invention, one or more of such ridge members may be employed in assembling the roof. For instance, it may be desired to form a roof having a single ridge at the center thereof wherein a single ridge member 24 of the present invention is positioned at the center or peak of the roof, as illustrated in the plan view of FIG. 10.

Alternatively, it may be desired to form a gambrel roof 26 as illustrated in FIG. 1, wherein one ridge member 24 is at the center or peak of the roof 26, with a pair of ridge members 24 spaced equally from either side thereof to further angle outer sections of the roof. By way of example, the gambrel roof 26 of FIG. 1 employs three ridge members 24 with each flexed to form an angle of approximately 150°.

The ridge member 24 of the present invention also allows for the formation of non-symmetrical roofs. For instance, a single ridge member 24 may be employed to form a single off-centered roof ridge, as illustrated in the plan view of FIG. 11. The above three examples are illustrative only, and are intended to illustrate some of the diverse roof formations attainable with the ridge member 24 of the present invention. However, it will be readily apparent to those in the art that the ridge member 24 allows for the formation of a virtually limitless number of roof configurations, allowing for great customization to suit the user's needs.

As stated above and illustrated in FIG. 8, the panels 14, which are employed as both wall panels and roof panels, are preferably formed of extruded polymeric material and include generally parallel front and rear sheets 52 and 54 with strengthening ribs 56 extending therebetween. This provides panels 14 having a cross section of minimal material, which allows for easy cutting of the panels 14 to any desired length and angle, thereby further facilitating customization of buildings to suit the requirements of a given user.

Figure 6:
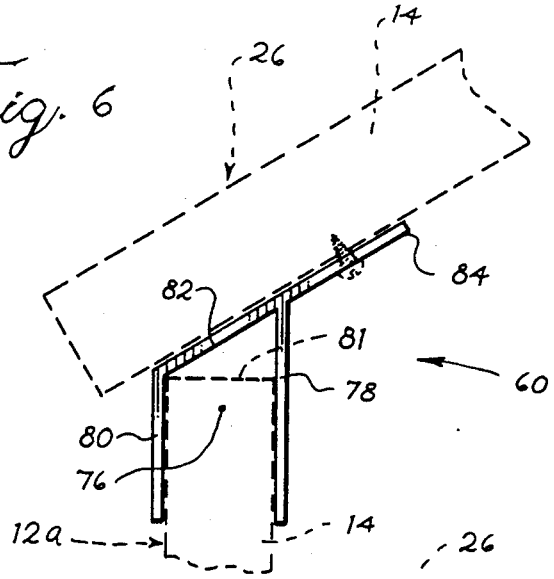
FIG. 6 is a side elevational view of an angled F-channel member.

The roof panels 14 extend perpendicularly to the front and rear walls **12*b* and extend at an angle with respect to the side walls 12*a*. Accordingly, the roof panels 14 are attached to the front and rear walls 12*b* of the building by perpendicular F-channel member 60 and attached to the side walls 12*a* by angled F-channel member 62, as illustrated in FIGS. 6 and 7**, respectively.

Figure 7:
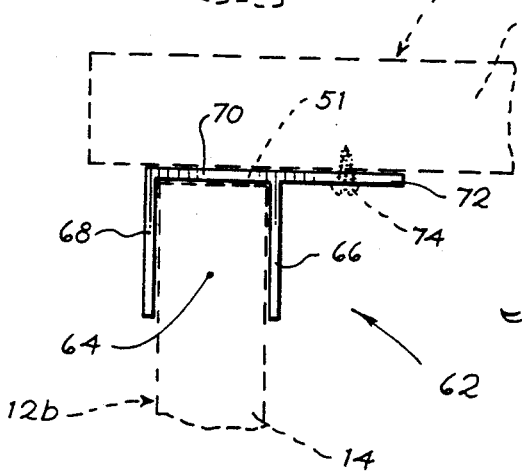
FIG. 7 is perpendicular F-channel member.

With initial reference to the perpendicular F-channel 62 of FIG. 7, it is an integral, elongated component having a channel 64 defined by generally parallel inner wall 66 and outer wall 68. An upper wall 70 spans the inner and outer walls 66 and 68 extending perpendicularly thereto, and includes an extension 72 which extends beyond the inner wall 66, perpendicularly thereto, as shown in FIG. 7. The perpendicular F-channel 62 is slid onto the upper ends 51 of the panels 14 which are assembled to form the front and rear walls **12*b*, with the upper ends 51 of the front and rear walls 12*b* being slidably received within the channel 64. Hence, the inner and outer perpendicular F-channel walls 66 and 68 straddle the panels 14**, forming a tight fit engagement therewith..

Screws 74 are then screwed through the extension 72 of the perpendicular F-channel member 62 and received in the panels 14 of the roof 26 to secure the roof panels to the perpendicular F-channel member 62 and, hence, the front and rear walls **12*b*, as shown in FIG. 7. The perpendicular F-channel 62** lends itself to production by extrusion of polymeric material, which process is preferred to minimize production costs.

The engagement of the roof panels 14 to the side walls **12*a* is similar to that described above with respect to the connection of the roof panels 14 to the front and rear walls 12*b*. Since the roof panels 14 extend at an angle with respect to the side walls 12*b*, angled F-channel members 64, such as that illustrated in FIG. 6, are employed to make the connection. As with the perpendicular F-channel member 62, the angled F-channel member 64 has a channel 76 defined by an inner wall 78 and an outer wall 80, and has an upper wall 82 which spans the inner and outer walls 78 and 80 at an angle, and includes an extension 84 which extends beyond the inner wall 78. The upper wall 82 of the angled F-channel member 60, which extends at an angle with respect to the front and rear channel walls 78 and 80, includes an extension 84 which extends beyond the inner channel wall 78** at an angle thereto.

The angled F-channel member 60 is placed onto the upper ends 81 of assembled side walls **12*a*, with the upper end 81 of the side walls 12*a* being received by tight fit engagement within the channel 76 of the angled F-channel member. Screws 74 are screwed through the angled extension 84 of the angled F-channel member 60 and received in the panels 14 of the roof 26 to secure the roof panels 14 to the side walls 12*a*, as shown in FIG. 6. The angled extension 84 may be made resiliently flexible with respect to the remainder of the upper wall 82 to allow attachment of roof panels to the side walls 12*a*** at various angles.

Hence, the panels 14 which form the roof 26 are rigidly secured to the front and rear walls **12*b* along their entire length by perpendicular F-channel members 62, and are rigidly secured to the side walls 12*a* by angled F-channel members 60. Thus, the roof 26 is rigidly secured to both the front and rear walls 12*b* and the side walls 12*a***.

The angular flexibility of the ridge member 24 also allows take up of the "play" associated with non-symmetrical opposite walls. That is, if the upper end 51 of the front wall **12*b* is at a different angle from horizontal than the upper end 51 of the opposite, rear wall 12*b*, a non-flexible ridge member would result in a gap between the roof panel 14 and the upper end 51 of the wall 14 at one end or both ends of the roof panel 14. Hence, while the opposite front and rear walls 12*b* would normally be substantially identical when supplied by the manufacturer with the upper ends of the panels pre-cut at the factory and sold as a package, there may be greater inaccuracies when the angled upper ends 51 of the panels 14 forming the front and rear walls 12*b* are cut by the user in customizing the building. The thin ridge portion 28 and angled wall portions 30 of the ridge member 24** are sufficiently thin that not only is angular bending of the ridge member attainable, but torsional bending or twisting of the ends of the ridge member relative to one another is also attainable.

By providing for such a torsionally flexible ridge member 24, one end of the ridge member 24 may be twisted and made askew with respect to the other end of the ridge member so that both ends of the ridge member can be in contact with respective opposite front and rear walls 12*b*, even though the walls have differing angles at their upper surfaces Thus, any gaps which might otherwise result from the angle at the upper end of the front wall 12*b* differing from the angle at the upper end of the opposite, rear wall 12*b*, across which the ridge member spans, may be substantially eliminated by twisting the ridge member 24.

A particularly advantageous feature of the ridge member 24 of the present invention is that it also serves as a sunroof to provide illumination to the interior of the building 10. As stated above, the angled wall portions 30 and ridge portion 28 of the ridge member 24 are thin, and are formed of a polymeric material which allows sunlight to pass therethrough. Hence, with roof panels 14 inserted into the channels 38, there is a space between the adjacent roof panels at which there is only the thin wall 30 of sunlight-transmitting polymeric material thereat. Sunlight thus passes through the thin wall 30 which spans the ends of adjacent roof panels 14, and into the interior of the building 10 to provide illumination. Since the ridge member 24 extends from the front wall to the rear wall 12*b*, sunlight enters the building along the entire length of the ridge member 24. Accordingly, no separate cut-outs need to be formed in the roof to provide illumination of the building interior. If greater lighting is necessary, additional ridge members 24 can be employed or ridge members 24 having a wider span between the channels 32 can be employed. Hence, a ridge member 24 is provided which allows for easy assembly and which serves as both an angular roof panel connecting member and as a sunroof.

While only specific embodiments of the invention have been described and shown, it is apparent that various alterations and modifications can be made therein. It is, therefore, the intention in the appended claims to cover all such modifications and alterations as may fall within the scope and spirit of the invention.

What is claimed is:

1. A ridge fitting for connecting a first roof section and a second roof section of a building at an angle with respect to one another, the ridge fitting comprising:

a first longitudinally extending channel for engageably receiving said first roof section;

a second longitudinally extending channel for engageably receiving said second roof section; and a thin, longitudinally extending interface spanning said first channel and said second channel, the interface being light transmitting to allow illumination of the interior of the building and being bendable about a longitudinal axis to allow variation of the angle between said first channel and said second channel.

2. A ridge fitting in accordance with claim 1 wherein the interface is formed of a material which allows variation of the angle between the first and second channel between approximately 170° and approximately 135°.

3. A ridge fitting in accordance with claim 1 wherein the first and second channels are defined by channel walls, with a first reinforcing bracket attached to one of the channel walls of the first channel of the ridge fitting and to the first roof section, and a second reinforcing bracket attached to one of the channel walls of the second channel of the ridge fitting and to the second roof section, the first and second reinforcing brackets thereby securing the first and second roof sections within the respective first and second channels.

4. A ridge fitting in accordance with claim 1 wherein said longitudinally extending interface is resiliently deflectable.

5. A ridge fitting in accordance with claim 1 wherein the interface is formed of a material having a flexural modulus of greater than 1,500 MPa.

6. A ridge fitting in accordance with claim 1 wherein said first and second channels are defined by integral, generally L-shaped, longitudinally extending sections depending from the undersides of the interface.

7. A modular building, comprising:

a pair of opposite walls both having a first wall section, the upper end of which is angled at a first angle from horizontal, and an adjacent second wall section, the upper end of which is angled at a second angle from horizontal;

roof panels spanning said opposite walls, with a first roof panel spanning the first wall sections of said pair of opposite sidewalls, and a second roof panel spanning the second wall sections of said pair of opposite walls; and a ridge fitting interconnecting said first and second roof panels;

said ridge fitting being generally symmetrical and having a central ridge portion extending longitudinally lengthwise thereof with angled sides extending from opposite sides of said central ridge extending at an angle with respect to one another;

said central ridge portion being flexible about a longitudinal axis to allow variation of the angle between said angled sides, and being light transmitting to allow illumination of the interior of the building; and means at said angled sides for engageably receiving the ends of said first and second roof panels to interconnect the roof panels at an angle to one another.

8. A modular building in accordance with claim 7 wherein said means for engageably receiving the ends of said first and second roof panels comprises generally L-shaped, longitudinally extending sections depending from the undersides of the angled sides, which define channels for slidably receiving the ends of adjacent roof panels therein.

9. A modular building in accordance with claim 7 wherein reinforcing brackets are connected to both the ridge fitting and the roof panels engaged therewith, to secure engagement of the roof panels with the ridge fitting.

* * * * *